US005732527A

United States Patent [19]

Schneider

[11] Patent Number: 5,732,527

[45] Date of Patent: Mar. 31, 1998

[54] PANEL LIFT APPARATUS

[76] Inventor: John E. Schneider, 4031 Mercer Rd., Bullhead City, Ariz. 86429

[21] Appl. No.: 670,555

[22] Filed: Jun. 27, 1996

[51] Int. Cl.[6] ..... E04D 15/00

[52] U.S. Cl. ..... 52/749.1; 52/127.2; 269/904

[58] Field of Search ..... 52/749.1, 749.11, 52/749.15, 127.2, DIG. 1; 269/217, 901, 904; 414/10–11

[56] References Cited

U.S. PATENT DOCUMENTS

| | | | |
|---|---|---|---|
| 4,027,802 | 6/1977 | Reynolds | 52/749.1 X |
| 4,068,427 | 1/1978 | Camardo | 52/749.1 X |
| 4,955,592 | 9/1990 | Brennan | 269/904 X |
| 5,025,607 | 6/1991 | Green et al. | 52/749.1 |
| 5,292,098 | 3/1994 | Worthington | 52/127.2 X |
| 5,322,404 | 6/1994 | Keller | 52/DIG. 1 |
| 5,329,744 | 7/1994 | Sumter | 52/749.1 |
| 5,547,922 | 8/1996 | Fara | 52/127.2 X |
| 5,617,698 | 4/1997 | Guilmette | 52/749.1 |
| 5,634,301 | 6/1997 | Koller | 52/127.2 |

*Primary Examiner*—Beth Aubrey
*Attorney, Agent, or Firm*—Olive & Olive, P.A.

[57] ABSTRACT

An apparatus illustrated in two embodiments assists a sole worker in the positioning and installing of ceiling panels, such as sheetrock, to ceiling joists. In the first embodiment, a panel is placed on an arm pivotably connected to a post firmly positioned between a floor and a ceiling. Upon the release of a lever, a pressurized gas cylinder causes the arm to lift the panel angularly into substantially horizontal orientation adjacent the ceiling joists. In the second embodiment a plate formed with a ramp portion extends at an angle to a bearing plate portion. The bearing plate portion is fastened to a ceiling joist with the ramp portion angled downward. A first edge of a ceiling panel is placed on the ramp and the opposite edge of the ceiling panel is lifted by a worker so that the first edge is forced upward on the ramp to rest on the bearing portion as the second edge is brought into a substantially horizontal position.

9 Claims, 6 Drawing Sheets

PANEL LIFT APPARATUS

BACKGROUND OF THE INVENTION

1. Field of the Invention

This invention relates to apparatus for the installation of building panels and more particularly to apparatus for lifting and supporting panels during installation to a ceiling.

2. Description of the Related Art

The installation of ceiling panels, whether composed of gypsum, commonly known as sheetrock, plywood or of other construction, involves strenuous effort. The panel to be mounted is typically four feet by eight feet in size, ⅛–⅝ inch thick, heavy and cumbersome. Each panel must be lifted to the ceiling height in a horizontal orientation and held in place for fastening, generally by nails or by screws. This installation process ordinarily requires two workers using supporting braces or scaffolding.

In limited conditions, one worker can install a panel ceiling alone, but the job is tedious and inefficient. A single worker installing a ceiling panel must lift the panel onto a scaffold and position the panel correctly prior to fastening it to a number of ceiling joists. In order for the spackle compound applied to seal the joints between adjacent panels to firmly adhere, a small space must be maintained between adjacent panels. Keeping this space open and uniform is somewhat difficult for an individual worker. Depending on the height of the ceiling and the height of the worker, some or all of these operations are performed on a ladder or scaffold.

It is therefore an object of this invention to provide an apparatus which is operable by a single worker for positioning a panel adjacent to ceiling joists prior to attachment thereto.

It is a further object of this invention to provide an apparatus for supporting the panel adjacent to ceiling joists during the installation of fasteners.

It is a still further object of this invention to provide an apparatus for positioning and supporting the panel adjacent to ceiling joists while maintaining a space between the panel being supported and an adjacent ceiling panel for joint spackle adhesion.

Other objects and advantages will be more fully apparent from the following disclosure and appended claims.

SUMMARY OF THE INVENTION

The panel lift apparatus of the invention is configured to be placed between the floor and the ceiling and in a first embodiment intended for large jobs has a mechanical arm which is extendable and a space retainer to properly position the panel being lifted relative to a previously installed ceiling panel. The panel lift apparatus receives a panel in a downwardly angled orientation from a single worker and mechanically lifts the panel to a horizontal orientation adjacent ceiling joists to which the panel is to be fastened. A pair of such panel lifting devices is typically used to lift and support each ceiling panel. After the panel has been fastened to the ceiling joists, the mechanical arm is lowered and the apparatus is moved to a new position to lift and position another ceiling panel.

In a second embodiment of the invention, intended for use for smaller ceiling jobs, a panel support brace is provided which is fastened to a ceiling joist to support a first edge of the ceiling panel. A single worker lifts the ceiling panel to place a first edge on the support brace while the opposite edge is held in a lower position. The worker then lifts the lower edge by hand or by use of a support frame to place the panel in horizontal orientation against the ceiling joists.

DETAILED DESCRIPTION OF THE INVENTION AND PREFERRED EMBODIMENTS THEREOF

Figure 1:
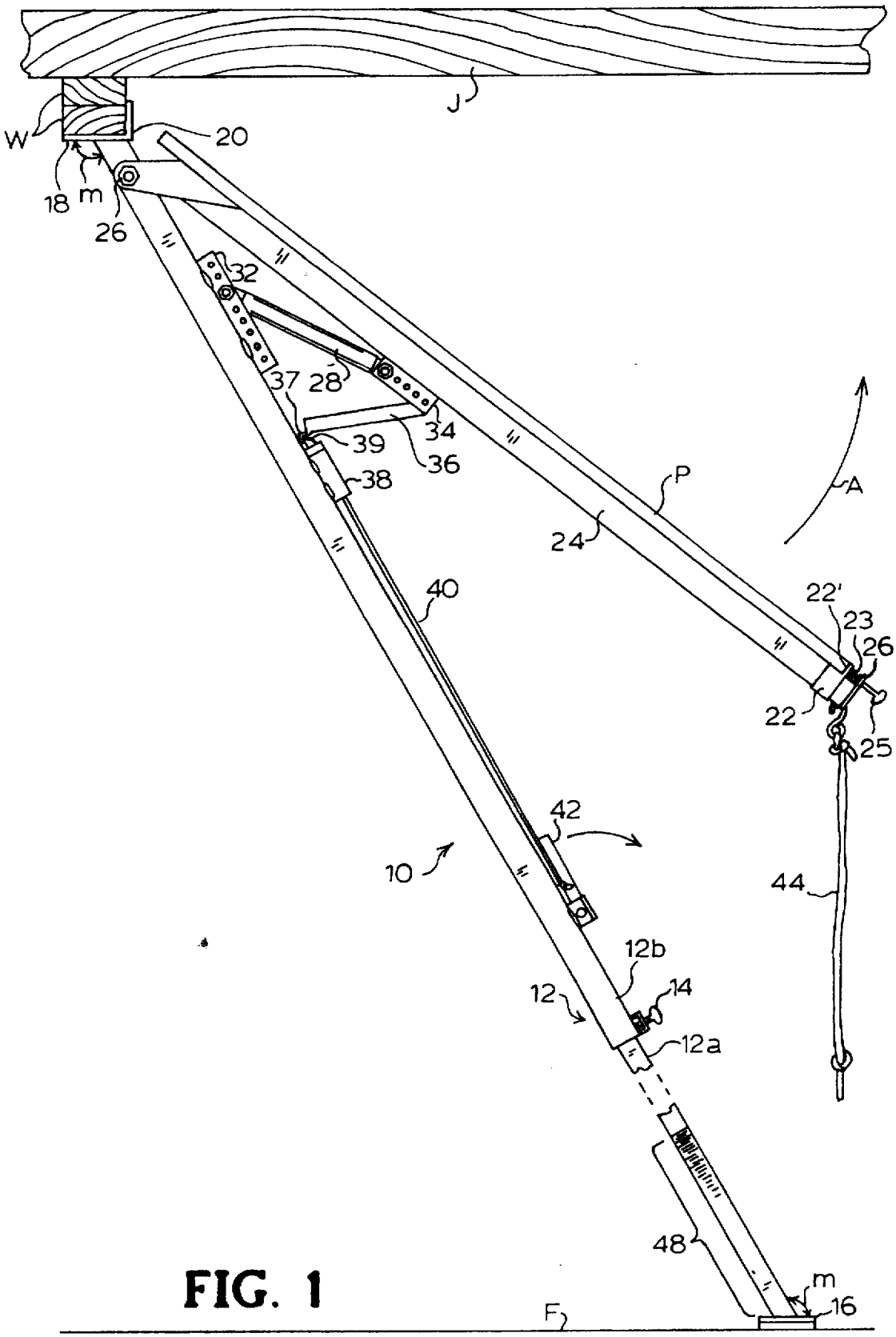
FIG. 1 is a side elevation view of a panel lift apparatus of the invention shown braced between a floor and a ceiling with its lifting arm in a lowered orientation and supporting a ceiling panel for installation.
Figure 1A:
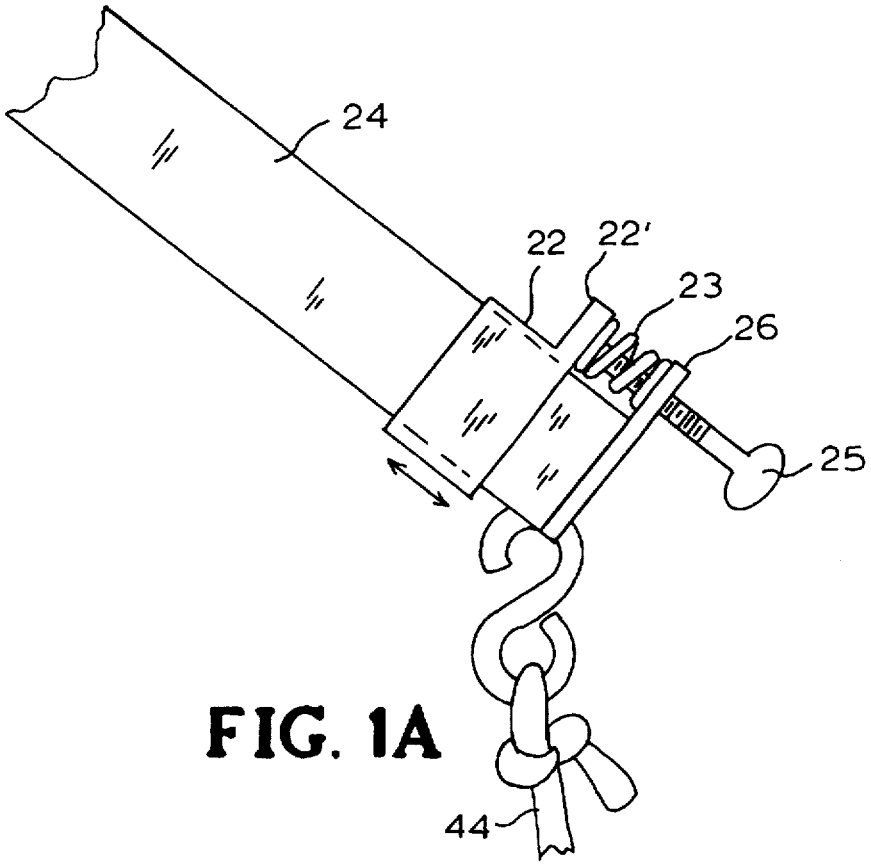
FIG. 1A is an enlarged side elevation view of the distal end of the lifting arm of the apparatus of FIG. 1 showing detail of a slidable panel retainer mounted thereon.
Figure 2:
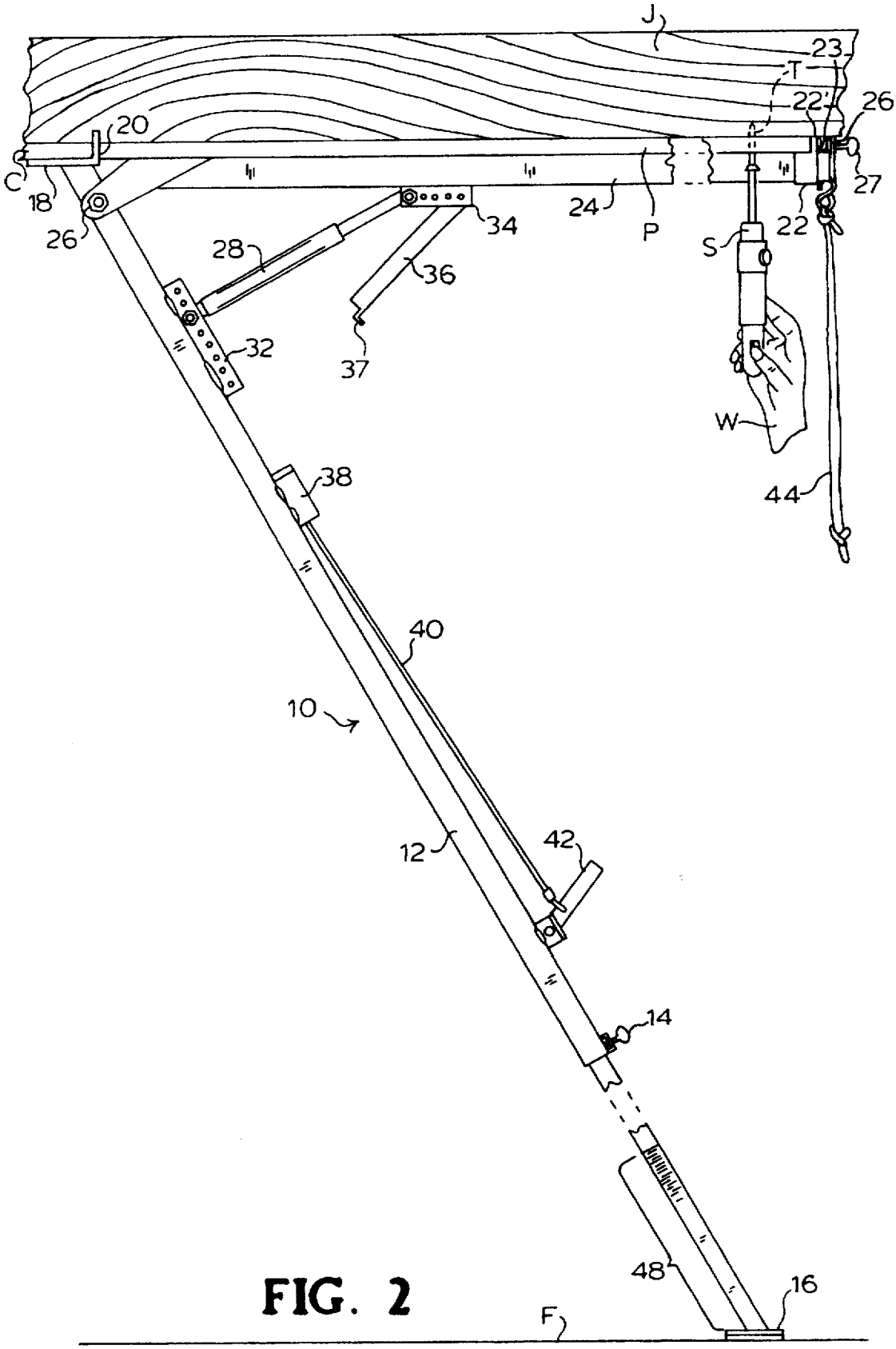
FIG. 2 is a side elevation view of the panel lift apparatus of FIG. 1 with its lifting arm extended and the ceiling panel being fastened to a ceiling joist.

The panel lift apparatus 10 of the invention, is illustrated in side elevation in FIGS. 1, 1A and 2 with a panel P, such as a piece of sheetrock, placed on arm 24 thereof. FIG. 1 shows panel lift apparatus 10 with its top end engaging wall top plate W so as to position a first ceiling panel P to be installed. Installation of a last panel is similar, with apparatus 10 engaging a top plate of the opposite wall. FIG. 2 shows panel lift apparatus 10 placed with its top end engaging a previously installed ceiling panel C so as to position an intermediate ceiling panel P to be installed.

Panel lift apparatus 10 has a plate 18 including a perpendicular stop 20 which is mounted to an upper end of post 12 at an angle m. Stop 20 may be higher than the thickness of a ceiling panel P. Plate 18 is held in contact with a rigid ceiling member, such as top plate W (FIG. 1 ) or previously installed ceiling panel C (FIG. 2). With plate 18 against previously installed panel C and plate stop 20 against its edge, apparatus 10 is placed between ceiling joists J so that plate 18 is flush to the lower surface of panel C. Plate stop 20 assists in the positioning and alignment of panel lift apparatus 10. Post 12 is made with inner sleeve 12*a* and outer sleeve 12*b* in telescoping relation so as to be capable of adjustment in length to accommodate differences in the distance from a floor F to a ceiling joist J in a particular building site. A lock 14, depicted in the preferred embodiment as a set screw, is fitted to secure the adjusted length of post 12. Foot 16 is connected to the lower end of post 12 at a complementary angle m to be in firm contact with floor F. The bottom surface of foot 16 is formed to enhance friction with floor F by attachment of a frictional pad or cleated protrusions.

Arm 24 is pivotally mounted adjacent the upper end of post 12 by pivot pin 26 and is formed of a length to accommodate the shorter dimension of panel P mounted thereon, with panel retainer 22 on the outer end thereof. Panel retainer 22 is spring-biased to ensure the uniform positioning of each panel being installed. Panel retainer 22 is formed of a short length of tubular material which is sized to slidingly mount on arm 24 (FIG. 1A). Panel retainer 22 is made with an upwardly directed lip 22' which is positioned to engage a lower edge of ceiling panel P. Panel retainer 22 is biased away from the distal end of arm 24 by compression spring 23 which is supported at its distal end by stop 26. An adjusting screw 25 is threaded through stop 26 and mounts spring 23 to provide a fixed stop for the travel of panel retainer 22. This spring-biased arrangement for panel retainer P enables consistent positioning of each ceiling panel P.

A lifter 28 is pivotally and adjustably mounted at a first end to post anchor 32 and at a second end to arm anchor 34. A change in the positioning of the pivot pins holding lifter 28 to each anchor 32, 34 will change the angle of motion (see arrow A) and the ending position of panel P. Lifter 28 is a gas-filled strut, in the preferred embodiment, but may be any device capable of extending arm 24 to lift panel P, such as a mechanical lever or motorized traverse screw. A hook 36 with downwardly directed tip 37 is fixedly secured to arm 24. Tip 37 is in a position to releasably engage retractable plunger 39 of latch 38 when arm 24 is in its lowered position, as in FIG. 1. A worker moves lever 42, which pulls leash 40, retracting plunger 39 of latch 38 so as to release tip 37 and allow lifter 28 to extend arm 24 to its raised position through an arc, shown by arrow A (see FIG. 1).

When arm 24 is extended to its raised, or horizontal, position, panel P is positioned adjacent ceiling joist J with its leading edge abutting the outer surface of stop 20 so as to retain a small and uniform space (FIG. 2) between itself and previously installed panel C. This retained space is filled with spackling compound in the process of joint sealing, as noted above. At the corner between the ceiling and the wall, the space that remains is closed by later installation of wall panels (not shown). As shown in FIG. 2, fastening may begin in any area of panel P. Panel P is mounted onto ceiling joists J by worker W with a fastening tool S such as the illustrated cordless power screw driver. It will be understood that actual contact between panel P and joist J is not necessary, so long as panel P is close enough to joist J to accommodate the length of fasteners being used. As discussed above in regard to the installation of the first ceiling panel P, shown in FIG. 1, when ceiling panel P is not flush to ceiling joist J, a selected location is found for a first fastener.

Figure 3:
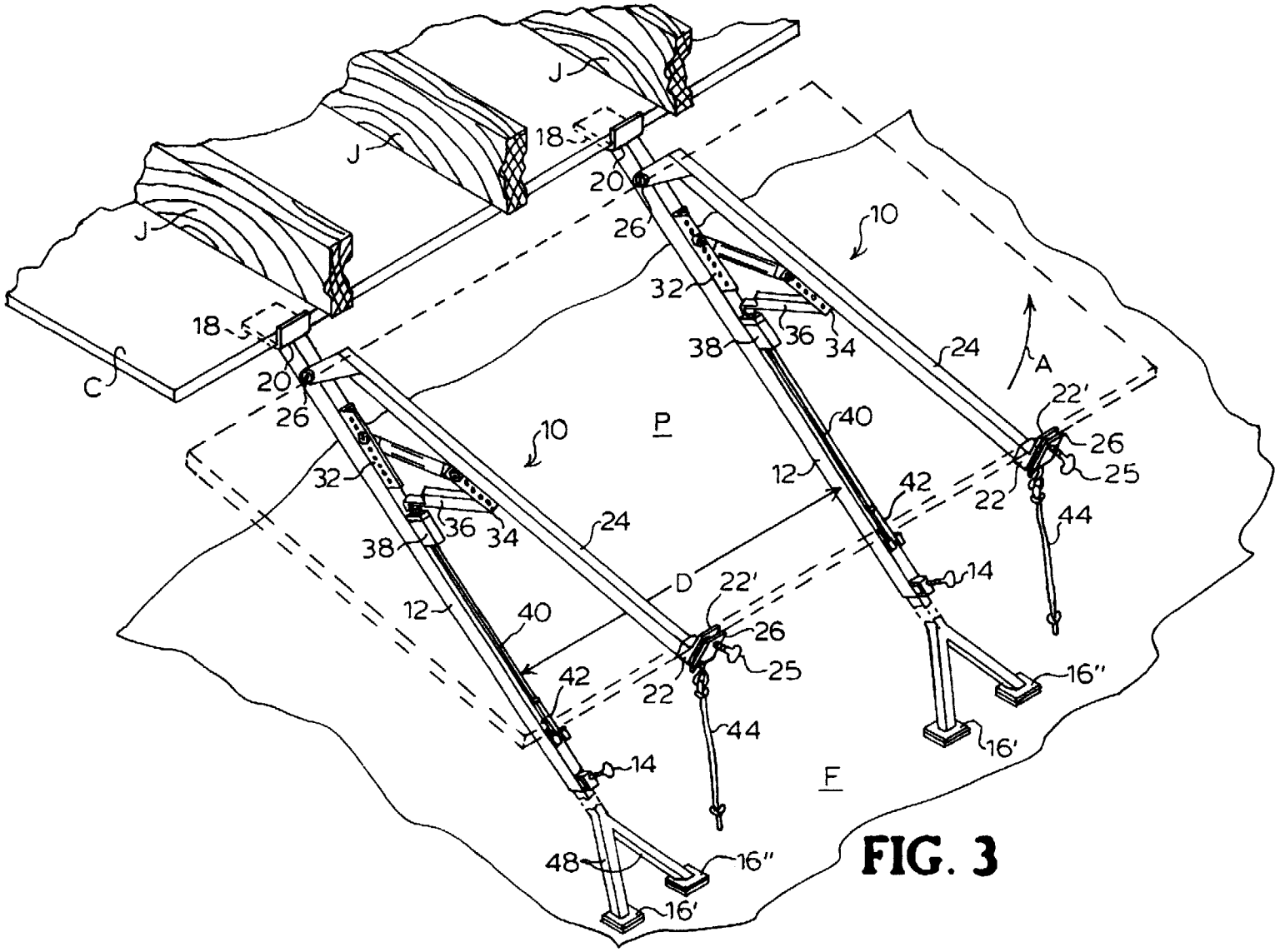
FIG. 3 is a perspective view of a pair of panel lifters holding a panel for positioning adjacent ceiling joists.

As shown in FIG. 3, it is typical to employ two panel lifting apparatuses of the invention to position a ceiling panel for installation. Ceiling joists J are shown shortened for purposes of illustration. Plate 18, of each post 12, is located adjacent, but not under, each joist J to be stable, without interference with stop 20. As panel P is placed on arms 24 with its eight foot length extending crosswise, the distance D between the two posts 12 is in the range of four to five feet. When using that typical spacing, a single worker is able to actuate both levers 42 simultaneously, as is preferred. After panel P has been fastened to ceiling joists J, leashes 44, either simultaneously or individually, are pulled to move each arm 24 down and to re-engage each respective tip 37 with the respective plunger 39 of latch 38 on each post 12. For greater stability, the lower portion 48 of each post 12 is divided to have a first foot 16' and a second foot 16" in contact with floor F. The invention recognizes that other forms of stabilizer for post 12 may be employed, such as connecting a rigid bar between two adjacent posts or mounting an elongated single foot 16 in perpendicular relation to a single post bottom. Also recognized by the invention is that in order to move the panel lift apparatus 10 of the invention to a new position for installation of a further ceiling panel, it is not necessary to adjust the length of post 12; it is merely necessary to lift lower portion 48 away from floor F and move post 12 to its new position. On placement in a new position, lower post portion 48 is tapped downward to press post 12 between floor F and ceiling joist J.

Figure 4:
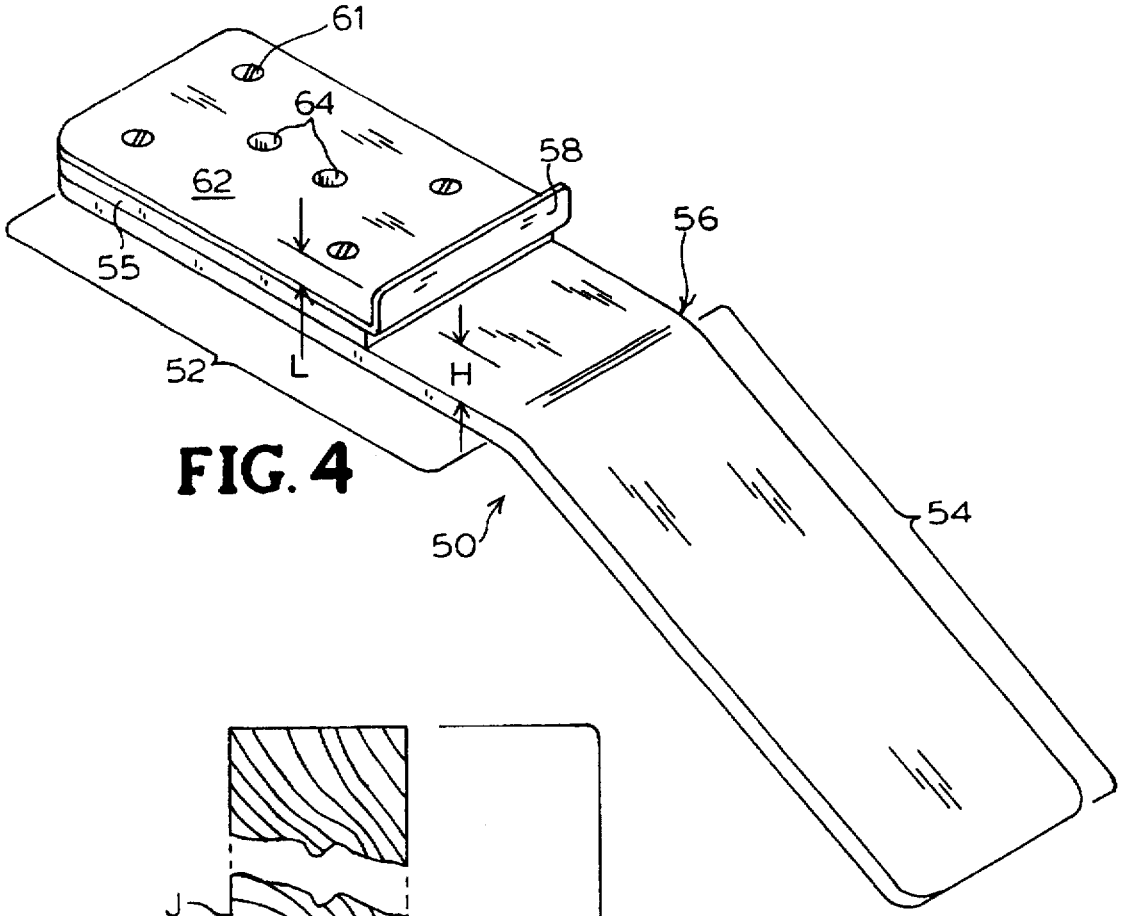
FIG. 4 is a perspective view of a panel support brace according to a second embodiment of the invention.
Figure 6:
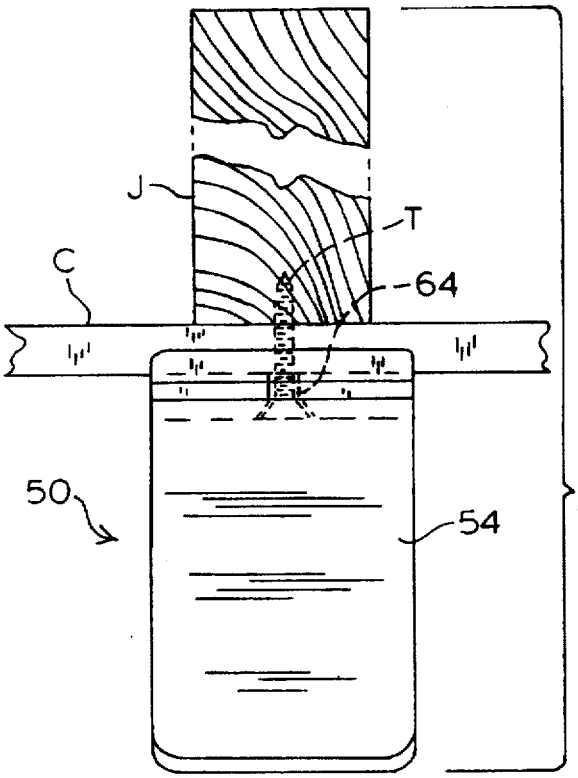
FIG. 6 is an end elevation view of the panel support brace of FIG. 4 fastened to a ceiling joist adjacent a previously installed ceiling panel.
Figure 5:
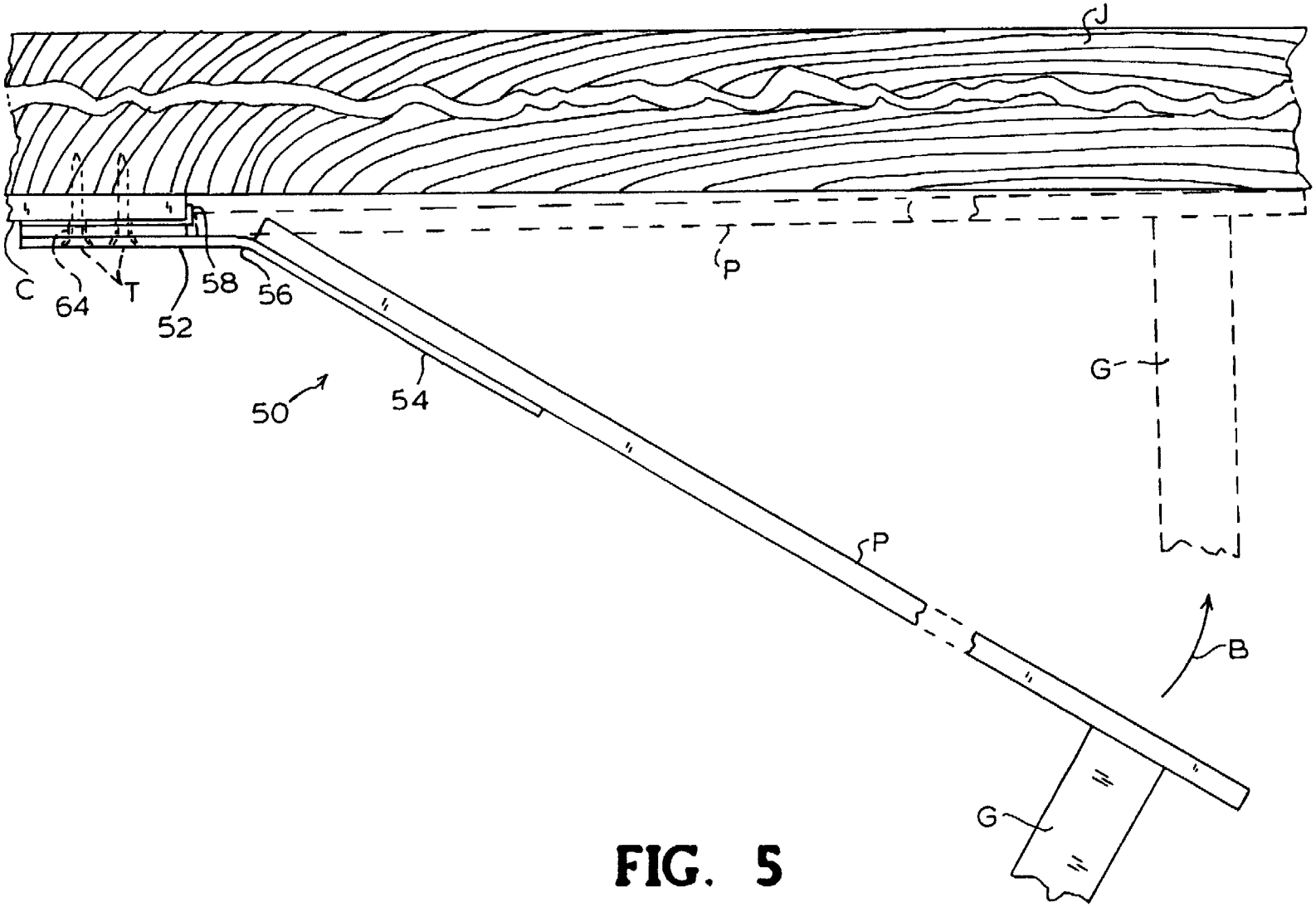
FIG. 5 is a side elevation view of the panel support brace of FIG. 4 with the leading edge of a panel shown in solid lines being supported on the brace and with the panel shown in dashed lines being lifted so as to be adjacent the ceiling joists.

While the panel lift apparatus described above is useful for the worker who frequently installs ceiling panels, it is potentially a large investment for one who installs such panels only rarely, such as a hobbyist. For this occasional user, a second embodiment of the invention is shown in FIGS. 4–6, being panel support bracket 50. Support bracket 50 is configured to be releasably assembled to a ceiling joist J to hold a single edge of a ceiling panel P (FIGS. 5, 6).

Panel support bracket 50 has a bearing portion 52 and a ramp portion 54, connected at break 56. In use, as shown in FIG. 5, bearing portion 52 is fixed and held parallel to ceiling joists J and an arm or ramp portion 54 is angled downward, such that an edge of panel P may be placed thereon and lifted into position parallel to ceiling joists J. A bearing plate 62 with a perpendicular plate stop 58 is secured by means of screws 61 to the upper surface of bearing portion 52 so that the height H from the top of bearing portion 52 to the top of stop 58 is no more than equal to the thickness of a thick ceiling panel P, i.e., ⅝ inch, to accept a sheetrock or other panel of any common thickness. Stop 58 serves the dual purposes of aligning the position of panel P and maintaining a uniform, small gap between adjacent panels P. In the example illustrated, bearing plate 62 is separated from bearing portion 52 of support bracket 50 by a spacer 55. Spacer 55 may be replaced by removing screws 61 and installing a spacer of different thickness to vary height H. A pair of aligned screw holes 64 are provided for fastening panel support bracket 50 to ceiling joist J. If desired, spacer 55 may be exchangeable to accommodate different thicknesses of ceiling panel P. The height L from the top surface of bearing plate 62 to the top of stop 58 is sufficient to align support bracket 50 with the edge of a previously installed sheet of ceiling panel P, but less than the thickness of a ceiling panel P.

In use, as shown in FIG. 5, each panel support bracket 50 is held to ceiling joist J by a pair of screw fasteners T which extend through screw holes 64 and a previously installed ceiling member, such as panel C. As is done with the first preferred embodiment of the invention when installing a first or last panel in a ceiling row, bracket 50 is fastened to a stud wall top plate. Two such support brackets are used at spaced apart locations. A first edge of ceiling panel P is placed on the ramp portion 54 of a secured support bracket 50 by a worker. A frame G is placed below the opposite edge of ceiling panel P, and ceiling panel P is raised to the position shown in dashed lines where it is fastened to ceiling joists J. Preferably, frame G is tall enough to rest on the floor to support panel P without being held up by hand.

Upon completion of the fastening of ceiling panel P, each support bracket 50 is removed and placed in a new location for the installation of an additional ceiling panel. The holes left by securing screws T are readily filled during the process of seam spackling which is done after all panels have been installed.

It is noted that there are substantial similarities between the structure and the function of the two embodiments disclosed. In each embodiment, the present invention provides a plate to be held securely in contact with a rigid ceiling member such as an installed ceiling panel, with a stop portion of the plate being of uniform thickness provided to establish a space of uniform width between the panel being installed and an adjacent panel. This retained space is filled with spackling compound during the process of joint sealing, as noted above. The space remaining in the corner between the ceiling and an adjacent wall is closed by the later installation of wall panels (not shown). The stop is also functional to assist in the alignment of the panel to be installed. Each embodiment has a downwardly angled portion for supporting the panel prior to the panel being lifted toward ceiling joists to which it will be anchored. Each embodiment supports at least a portion of the panel after lifting and during the step of fastening to the joists.

The components of both embodiments of the invention are preferably formed of rigid and relatively strong metal structural members, such as those made from steel or aluminum.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. An apparatus for supporting a ceiling panel to be fastened to a number of ceiling joists, comprising:

(a) a plate including a plate stop extending upwardly from said plate in substantially perpendicular relation thereto for aligning and positioning said plate with respect to the ceiling joists;

(b) a post extending from a bottom end to a top end, said plate being rigidly connected to said post top end in angular relation enabling said plate to be releasably held horizontally in contact with a rigid ceiling member; and (c) a panel support member pivotally connected to said post adjacent said top end and extending outwardly and downwardly when said plate is held horizontally;

wherein said plate stop is adapted to engage an edge of said ceiling member and said panel support member is an arm pivotally assembled to said post adjacent said top end thereof and is operative for angularly raising said ceiling panel.

2. An apparatus for lifting and supporting a panel to be fastened to a number of ceiling joists, comprising:

(a) an extensible post having a top end and a bottom end and being capable of extending from a floor to a ceiling member, said post having a foot mounted at said bottom end for engaging said floor and a plate mounted on said top end for engaging said ceiling member;

(b) an arm for supporting said panel and connected to said post adjacent said top end so as to be pivotable from a lowered position to a raised position wherein said panel is substantially adjacent said ceiling joists; and (c) controllable means for pivoting said arm from said lowered position to said raised position.

3. The apparatus as described in claim 2, wherein said foot comprises means for frictionally engaging said floor.

4. The apparatus as described in claim 2, wherein said plate comprises means to mechanically position and align a portion of said post top end with respect to a fixed ceiling member.

5. The apparatus as described in claim 2, wherein said controllable means for pivoting said arm from said lowered position to said raised position comprises a pressurized gas strut.

6. The apparatus as described in claim 5, further comprising hook and latch means mounted respectively on said arm and said post in respective positions to engage one another when said arm is in said lowered position.

7. The apparatus as described in claim 3, wherein a lower portion of said post is divided to provide a dual foot portion.

8. The apparatus as described in claim 2, further comprising a panel retainer slidingly mounted on said arm adjacent a distal end thereof and biased away from said distal end.

9. An apparatus for supporting a ceiling panel to be fastened to a number of ceiling joists, comprising:

(a) a bearing plate configured for being releasably fastened in horizontal orientation to one of said number of ceiling joists;

(b) a ramp rigidly connected to said bearing plate and extending outwardly and downwardly therefrom when said bearing plate is held horizontally and configured for supporting a first edge of said ceiling panel when a second edge of said ceiling panel is raised; and (c) a plate stop secured to and extending upwardly from said bearing plate in substantially perpendicular relation thereto for aligning and positioning said bearing plate and ramp with respect to said panel to be fastened to the ceiling joists.

* * * * *